US005320125A

United States Patent [19]

Barnhart

[11] Patent Number: 5,320,125

[45] Date of Patent: Jun. 14, 1994

[54] COMPARTMENTIZED HAIRBRUSH

[76] Inventor: Nicholas W. Barnhart, 1039 W. Highway #26, Blackfoot, Id. 83221

[21] Appl. No.: 82,253

[22] Filed: Jun. 23, 1993

[51] Int. Cl.[5] ..... A45D 44/18

[52] U.S. Cl. ..... 132/313; 132/297; 132/304; 132/314; 132/317

[58] Field of Search ..... 132/287, 297, 301, 304, 132/313, 314, 315, 316, 317, 102, 103; 206/581, 823

[56] References Cited

U.S. PATENT DOCUMENTS

| | | | |
|---|---|---|---|
| 168,428 | 10/1875 | Teets . | |
| 497,451 | 5/1893 | Kintner | 132/313 |
| 753,520 | 3/1904 | Schneider | 132/313 |
| 1,094,493 | 4/1914 | Taber | 132/313 |
| 1,333,907 | 3/1920 | Dunham | 132/103 |
| 1,515,120 | 11/1924 | Kasdan et al. | 132/297 |
| 1,669,100 | 5/1928 | Overholt | 132/103 |
| 1,727,007 | 9/1929 | Eyster | 132/313 |
| 2,103,577 | 12/1937 | Farrell | 132/316 |
| 2,796,070 | 6/1957 | Marsak | 132/313 |
| 4,716,916 | 1/1988 | Burns | 132/313 |
| 5,012,831 | 5/1991 | Canela | 132/313 |

*Primary Examiner*—Gene Mancene
*Assistant Examiner*—Frank A. LaViola
*Attorney, Agent, or Firm*—Hopkins, French, Crockett, Springer & Hoopes

[57] ABSTRACT

A compartmentized hairbrush is disclosed having a cavity in the handle for lipstick, a pair of cavities in the body for makeup tools and a third cavity in the body for cosmetic products. The cosmetic products are within an interchangeable cartridge(s) having a groove on the bottom that engages a mating tongue in the body cavity to retain the cartridge(s) in the cavity.

2 Claims, 4 Drawing Sheets

COMPARTMENTIZED HAIRBRUSH

BACKGROUND OF THE INVENTION

1. Field Of The Invention

This invention relates to a hairbrush having compartments for a mirror, cosmetic powders, cosmetic application tools, and lipstick.

2. Description Of The Prior Art

A U.S. Pat. No. 5,012,831 issued to Canela discloses a hairbrush having a removable hinged mirror and cavities for containing powders, lipstick, mascaras, and an eyebrow pencil, all within a rather bulky handle. U.S. Pat. No. 4,716,915 issued to Burns discloses a hairbrush having a folding or sliding handle, removable mirror, hair spray dispenser, and, in one embodiment, a battery operated light. U.S. Pat. No. 168,428 issued to Teets in 1875 discloses a hairbrush with compartments for a comb, perfume, soap, razor, strop, and a fixed mirror on top of the brush portion. This forces the user to either use the brush or look in the mirror but not together unless the lid is removed. This would also require that the soap, lather brush, and perfume be removed to avoid their dropping out of the cavity. Access to the comb, strop, and razor is by removing an end cap on the handle. None of the above inventions disclose a means for retaining the powder containers nor tools within the body of the brush when the cover is not in place.

SUMMARY OF THE INVENTION

It is the purpose of this invention to provide an easily held brush that contains the necessary make-up tools and products in an easily accessible sliding cover and cap arrangement and that has a novel tongue and groove cosmetic product retaining means on the replaceable cosmetic cartridges.

The tools include a blush brush and eye shadow applicator the cartridges contain powders and the handle contains a lipstick tube. These tools are held within the body by an interference fit between the handle and the cavity wall, so they do not fall out when the brush is inverted.

The invention generally stated provides:

a compartmentized hairbrush comprising:

a body having a top and bottom portion, said bottom portion having bristles;

a face plate slidably attached to the top portion of the body, a mirror slidably inserted into the face plate;

a handle affixed to the body;

a cap on the handle having an attached lipstick sheath, the cap covering a tube cavity within the handle;

multiple cavities on the top portion of the body for retaining cosmetic products and make-up tools wherein the cosmetic products are within a replaceable cartridge having a cartridge groove that is engaged by a tongue on the body cavity thereby slidable retaining the cartridges within the body, and the makeup tools are held by a restraining means.

DETAILED DESCRIPTION OF THE PREFERRED EMBODIMENTS

Figure 1:
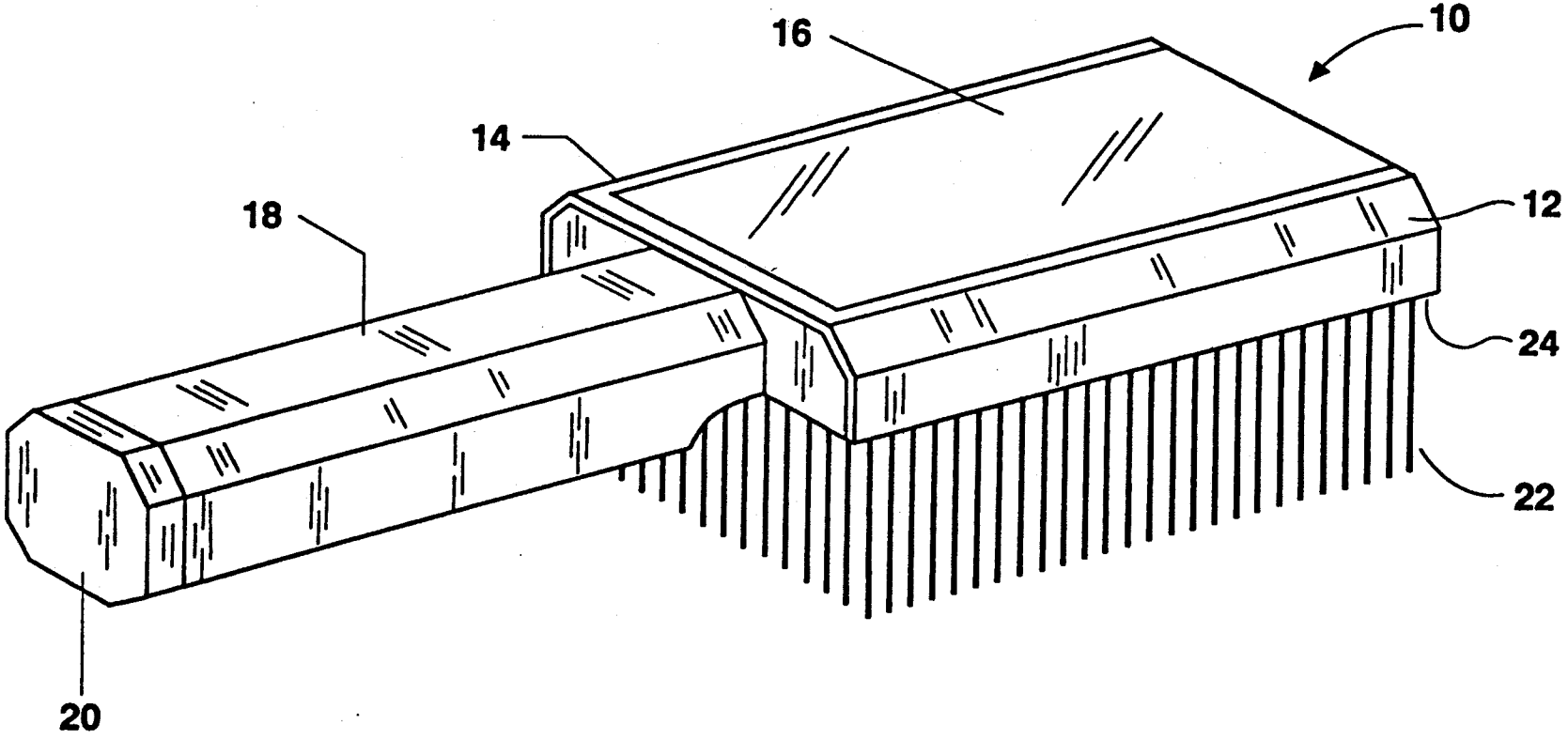
FIG. 1 is a front perspective view of the hairbrush of the present invention.

Referring to FIG. 1, the compartmentized hairbrush 10 is illustrated with the sliding face plate 12 in a closed position over the top of body 14. A removable mirror 16 is slidably inserted in the top of face plate 12, and handle 18 is attached to the body 14. A cap 20 is attached to an end of the handle and bristles 22 are on a bottom portion 24 of the body.

Figure 2:
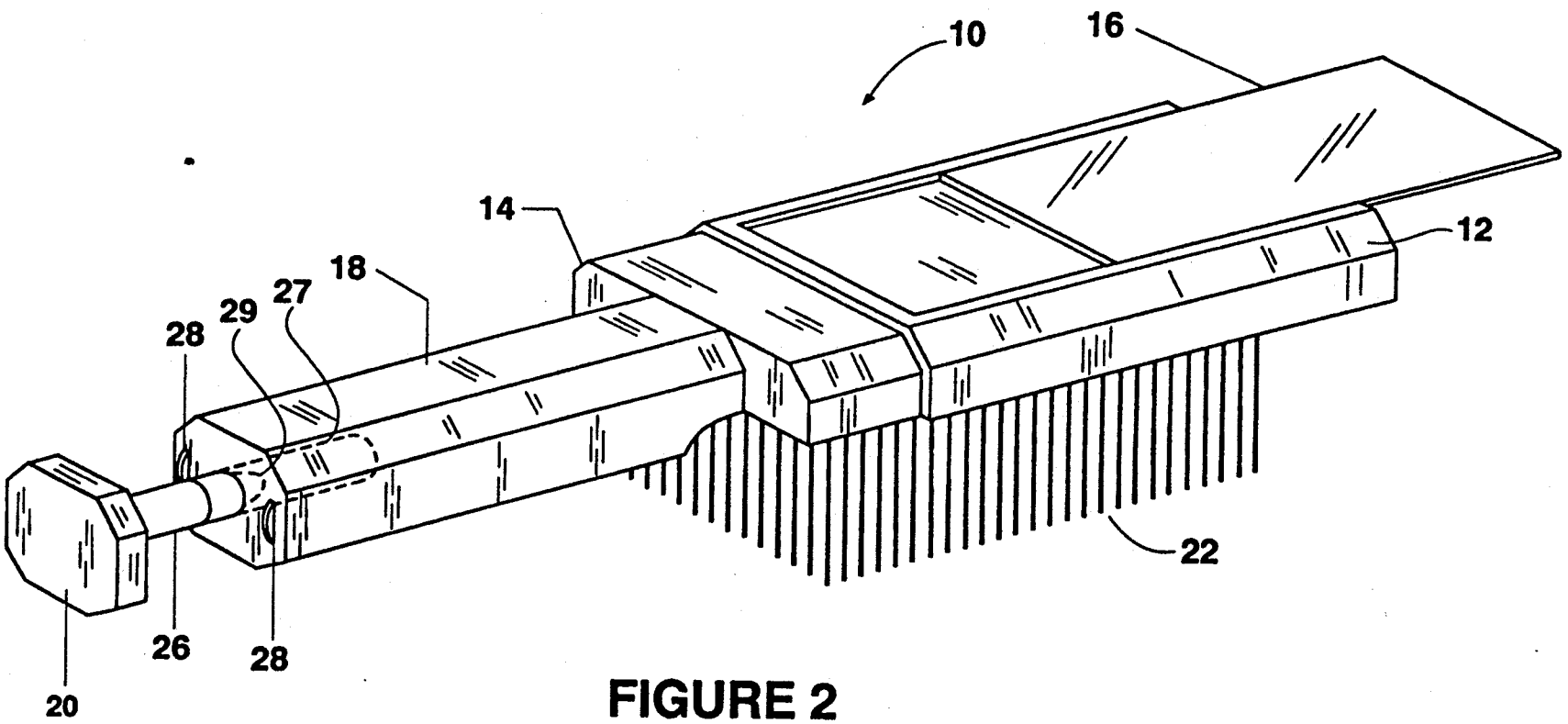
FIG. 2 is a front perspective view of the hairbrush having a mirror and face plate partially withdrawn.

FIG. 2 illustrates the brush 10 with the removable mirror 16 partially withdrawn, the sliding face plate 12 partially withdrawn and cap 20 removed from handle 18 to provide access to makeup tube sheath 26 within the tube cavity 27. The makeup or lipstick tube sheath 26 contains a lipstick 29, mascara, or coverstick and allows the lipstick to be set in an upright position. Cap 20 is retained in a closed position by a pair of clips 28.

Figure 3:
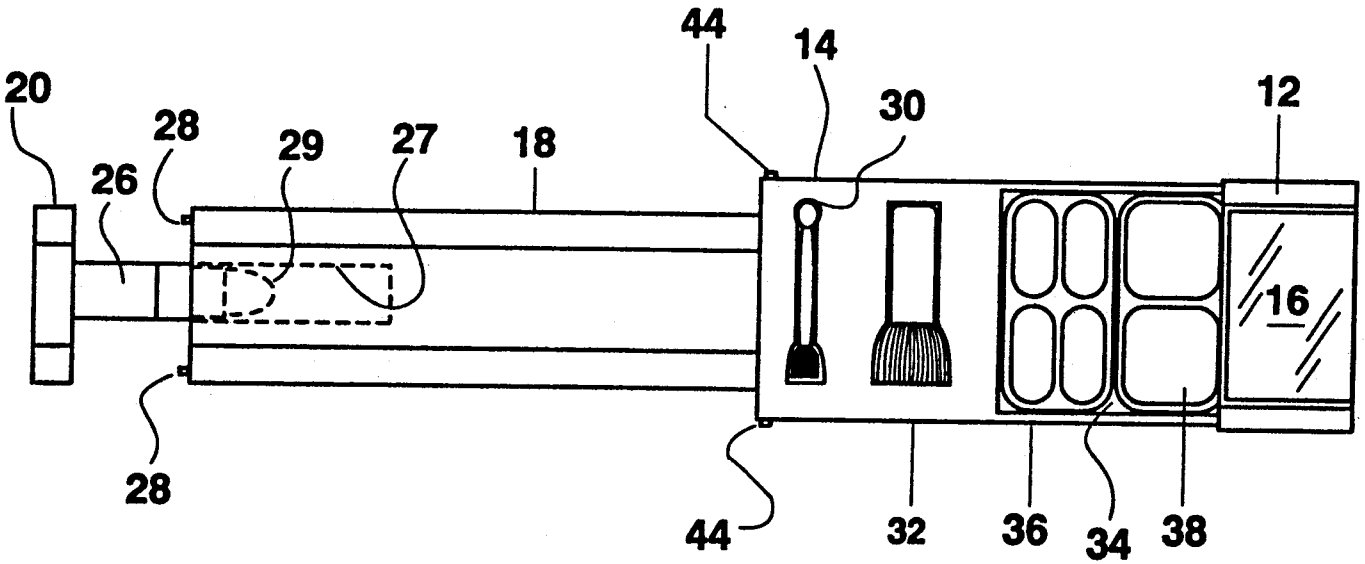
FIG. 3 is a plan view of the hairbrush with the face plate withdrawn.

FIG. 3 illustrates the cosmetic compartment with the sliding face plate 12 withdrawn. The cosmetic compartment has multiple cavities for makeup tools, i.e. an applicator cavity 30, a blush brush cavity 32 and a replaceable cosmetic cartridge cavity 34, having one or more small and large replaceable cartridges 36 and 3 that typically would contain various colors of face powders.

Figure 4:
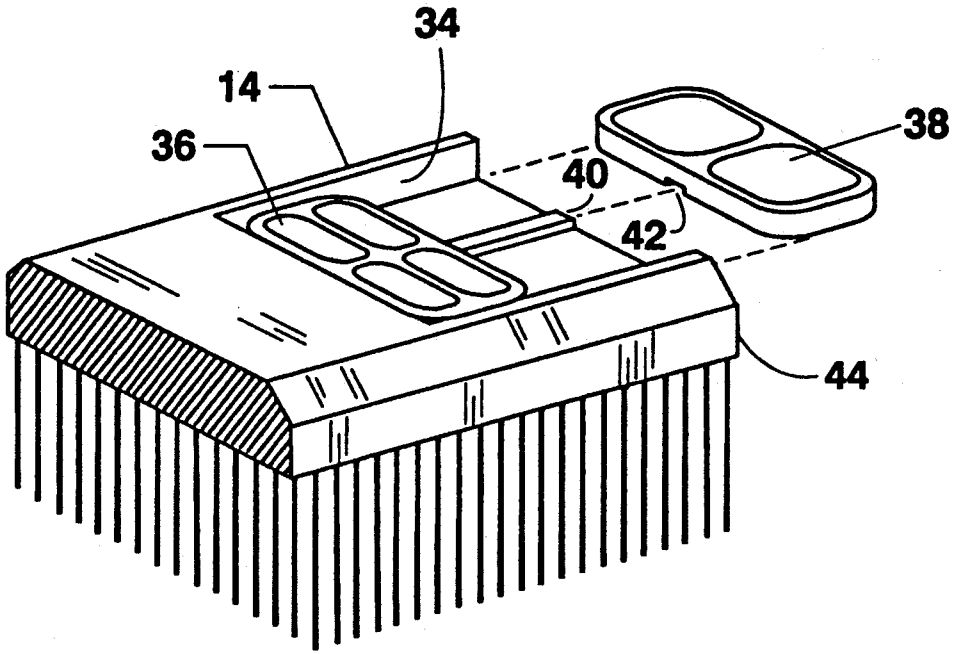
FIG. 4 is a partial front perspective view of the hairbrush cosmetic compartment.

In FIG. 4, the method of attaching the cartridge 38 to the body 14 can be seen. A V-shaped tongue 40 on the body 14 engages a groove 42 on the bottom surface of cartridge 38 slidably retaining the cartridge within cavity 34. The user can therefore select any combination of colors and cartridge sizes to suit her personal taste. When the sliding face plate 12 is closed or open, it engages tabs 44 (FIG. 3) to secure the face plate 12 to the body 14.

It should be noted that the cartridge groove 42 can be used with other cosmetic products or cosmetic dispensers that have a matching tongue.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A compartmentized hairbrush comprising:

a. a body having a top and bottom portion;

b. a face plate slidably attached to the top portion of the body;

c. a mirror slidably inserted into the face plate;

d. a handle affixed to the body;

e. a cap on the handle having an attached lipstick sheath, the cap covering a lipstick tube cavity within the handle; and f. three cavities on the top portion of the body a first cavity retaining cosmetic products, and a second and third cavity for retaining makeup tools by a cavity retaining means, wherein the cosmetic products are within a replaceable cartridge having a cartridge groove that is engaged by a tongue on a body cavity thereby slidably retaining the cartridges within the body.

2. The hairbrush as recited in claim 1 wherein the cavity retaining means is an interference fit between a cavity wall and the makeup tools.

* * * * *